US007464737B2

(12) United States Patent
Duginske

(10) Patent No.: US 7,464,737 B2
(45) Date of Patent: Dec. 16, 2008

(54) WOODWORKING MACHINERY STOP AND TRACK SYSTEM

(75) Inventor: Mark A. Duginske, Merrill, WI (US)

(73) Assignee: Allen IP Inc., Huxley, IA (US)

( * ) Notice: Subject to any disclaimer, the term of this patent is extended or adjusted under 35 U.S.C. 154(b) by 506 days.

(21) Appl. No.: 10/944,035

(22) Filed: Sep. 17, 2004

(65) Prior Publication Data

US 2005/0056345 A1 Mar. 17, 2005

Related U.S. Application Data

(60) Provisional application No. 60/503,609, filed on Sep. 17, 2003.

(51) Int. Cl.
*B27B 31/00* (2006.01)

(52) U.S. Cl. ..... 144/253.1; 269/303; 83/468.2; 83/468.3

(58) Field of Classification Search ..... 144/253.1, 144/253.3, 145.1; 83/468, 468.2, 468.4, 83/468.7, 438; 269/303, 304, 306, 315
See application file for complete search history.

(56) References Cited

U.S. PATENT DOCUMENTS 1,285,628 A 11/1918 Craley (Continued)

OTHER PUBLICATIONS

Laguna Tools; Webpage at www.lagunatools.com; LM410 Combination Machine; Printed Jan. 6, 2003.

(Continued)

*Primary Examiner*—Shelley Self
(74) *Attorney, Agent, or Firm*—Shumaker & Sieffert, P.A.

(57) ABSTRACT

A woodworking machinery jig and fixture system has a stop with a half-dovetail surface and can be provided with one or more T-slots. The half-dovetail surface can be clamped against a half-dovetail surface on the support, or against a flat surface. In one of the stops, the base has multiple through holes, any one of which can be used to mount a flip stop arm so as to vary the height of the arm or use a zero clearance fence. A track for the system has a flange that helps locate the track along the rear corner of a wood fence and also helps secure the track to the wood fence with fasteners through holes that can be drilled in the flange using a drill guide groove formed in the flange. Tension screws are provided in the stop and in the base for eliminating play between the hinge pin, the flip stop and the base. A lens is received in a groove of the stop arm and extends therefrom in position to view a ruler that is mounted on top of the support, facing up. The projection on the bottom of the base that fits into a T-slot is bordered by an angled surface that cams against the corner of the T-slot to push the other edge of the projection against the other corner of the T-slot when the base is assembled to the track, to provide a snug fit between the base and the track. The stops are provided with accessory mounting slots. A fixed stop with a half-dovetail surface, lens groove and accessory mounting slots can be mounted to a standard 2×4 that has a mating half-dovetail surface or a flat surface. A miter fixture can be mounted to the accessory slots that has fingers with ends that provide surface support of the mitered end of a workpiece whether the workpiece is supported with its point toward or away from the working plane of the support.

19 Claims, 15 Drawing Sheets

U.S. PATENT DOCUMENTS

| | | | | | |
|---|---|---|---|---|---|
| 1,994,422 | A | | 3/1935 | Sasek | |
| 2,260,708 | A | | 10/1941 | French | |
| 2,285,897 | A | | 6/1942 | Campbell | |
| 2,787,301 | A | | 4/1957 | Anderson | |
| 3,827,686 | A | | 8/1974 | Storkh | |
| 3,994,484 | A | | 11/1976 | Schorr | |
| 4,256,000 | A | | 3/1981 | Seidel | |
| 4,693,158 | A | | 9/1987 | Price | |
| 4,747,330 | A | | 5/1988 | Carithers, Jr. | |
| 4,817,693 | A | | 4/1989 | Schuler | |
| 4,871,156 | A | | 10/1989 | Kozyrski et al. | |
| 4,887,653 | A | | 12/1989 | Thomas | |
| 5,018,562 | A | | 5/1991 | Adams | |
| 5,038,486 | A | | 8/1991 | Ducate, Sr. | |
| 5,063,983 | A | | 11/1991 | Barry | |
| 5,337,641 | A | * | 8/1994 | Duginske | 83/468 |
| 5,443,554 | A | * | 8/1995 | Robert | 83/468.7 |
| 5,490,665 | A | | 2/1996 | Thiele et al. | |
| 5,553,644 | A | * | 9/1996 | Adams | 144/253.2 |
| 5,608,970 | A | | 3/1997 | Owen | |
| 5,617,909 | A | | 4/1997 | Duginske | |
| 5,662,019 | A | | 9/1997 | Denman | |
| 5,695,178 | A | | 12/1997 | Lenzkes | |
| 5,716,045 | A | | 2/1998 | Taylor | |
| 5,768,966 | A | | 6/1998 | Duginske | |
| 5,979,283 | A | | 11/1999 | Osborne | |
| 6,189,429 | B1 | | 2/2001 | Liu | |
| 6,557,601 | B1 | * | 5/2003 | Taylor | 144/253.1 |
| 6,851,243 | B1 | | 2/2005 | Sandford | |
| 6,880,442 | B2 | | 4/2005 | Duginske | |
| 2002/0194971 | A1 | | 12/2002 | Park et al. | |
| 2006/0248998 | A1 | | 11/2006 | Duginske | |

OTHER PUBLICATIONS

Martin Woodworking Machines Corp.; Webpage at www.martin-usa.com; Sliding Table Saw T 73, including T 73 Basic, T 73 Classic, and T 73 CNC; Printed Jan. 6, 2003.

Festool USA Tooltechnic Systems, LLC, MFT 800/MFT1080 Table, Master Festool USA Catalog 2005, (3 pages).

Office Action dated Dec. 31, 2007 for U.S. Appl. No. 11/381,805, 17 pages.

U.S. Appl. No. 12/106,867, filed Apr. 21, 2008, entitled, "Insert Plate Leveling", Clark.

"Mechanical Engineers' Handbbook", McGraw-Hill Book Company, Inc. 1958, Chapter 8, p. 134.

"Fine Woodworking", Remedy for a Worn Miter Gauge, Jul./Aug. No. 53, 1985, (3 pages).

"Fine Woodworking", Miter Gauges, Apr. 1992, (3 pages).

"1992 GarrettWade Tool Catalog", front and back cover pages and pp. 72-85 and 166, Garrett Wade Company, Inc.

"Joiner's Edge High Precision T-Slot Extrusion Modular 3-in 2 Woodworking System", Schuler Toolworks, Ltd., (1 page), 1991.

WoodsmithShop Catalog, "Adjustable Miter Fence", (2 pages, )1994.

"Vega Performance Miter Gage", (2 pages), Aug. 1994.

* cited by examiner

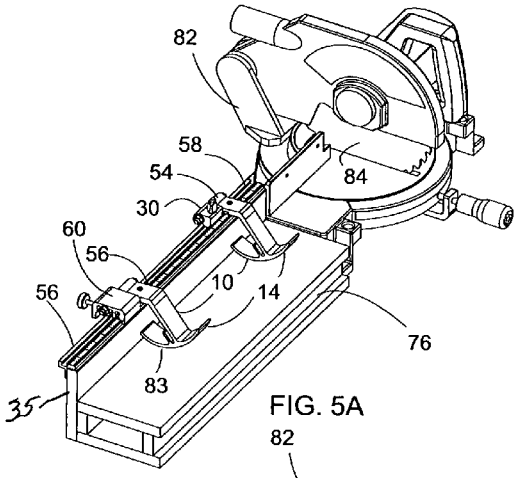
FIG. 5A
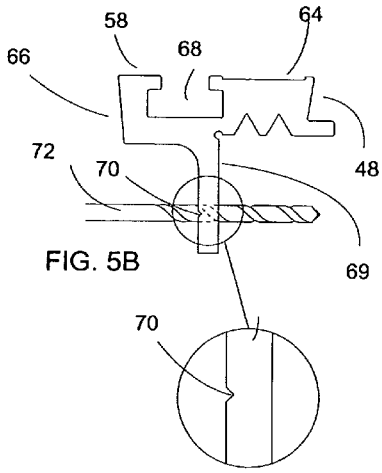
FIG. 5B
FIG. 5C
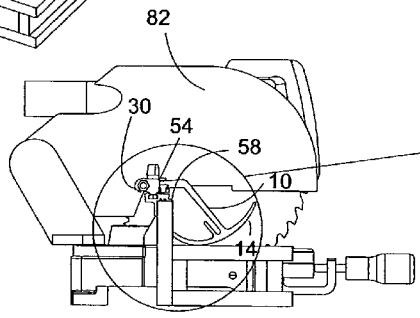
FIG. 6A
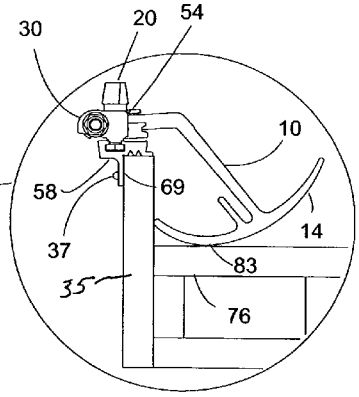
FIG. 6B
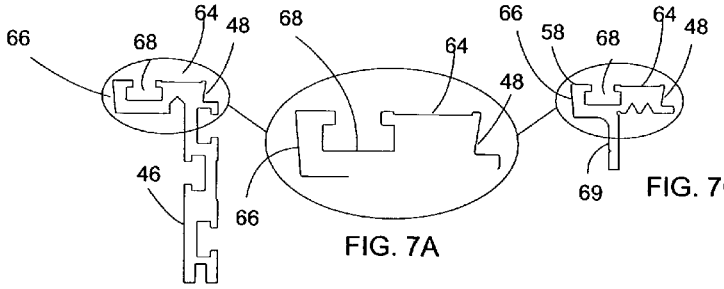
FIG. 7A
FIG. 7B
FIG. 7C

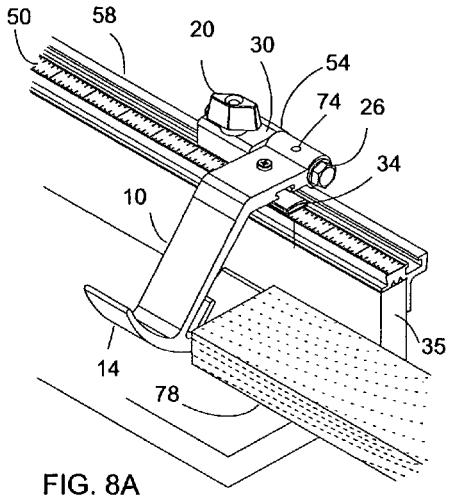
FIG. 8A
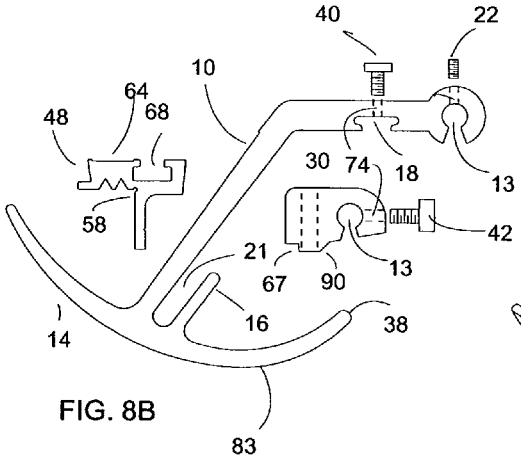
FIG. 8B
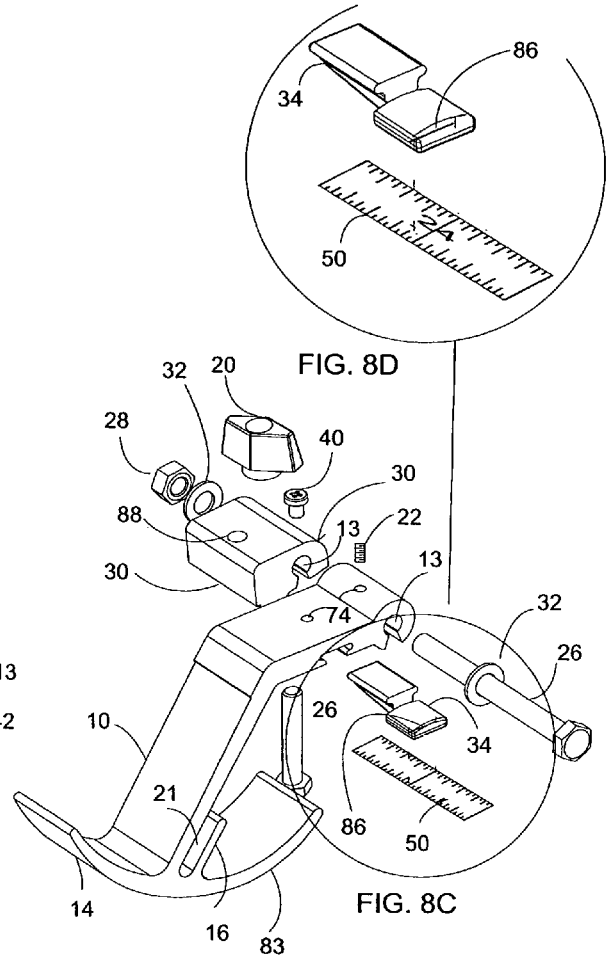
FIG. 8D
FIG. 8C
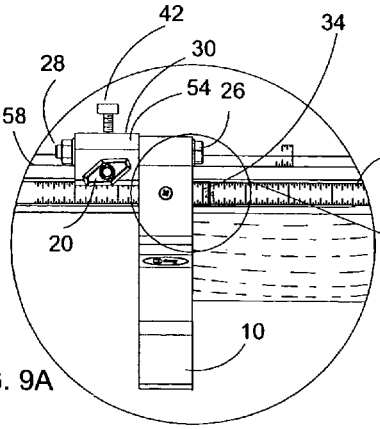
FIG. 9A
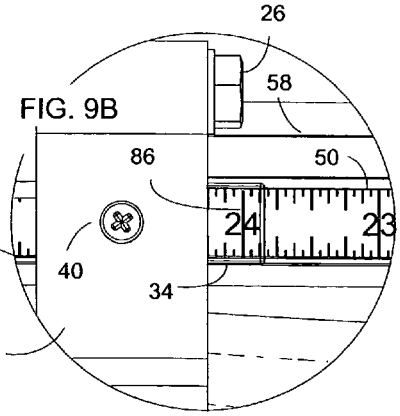
FIG. 9B

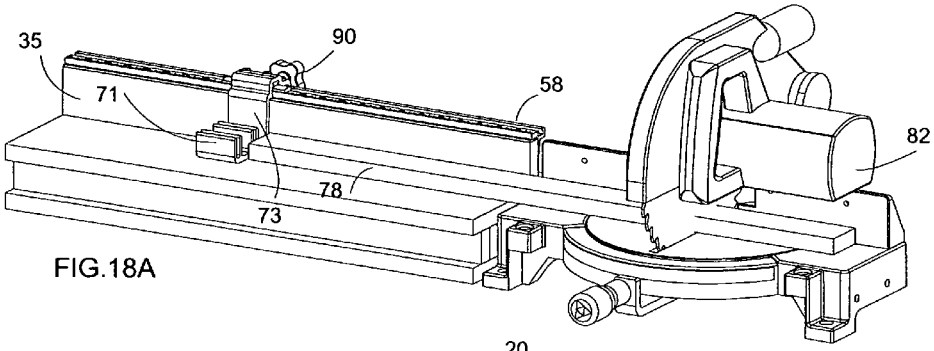
FIG.18A
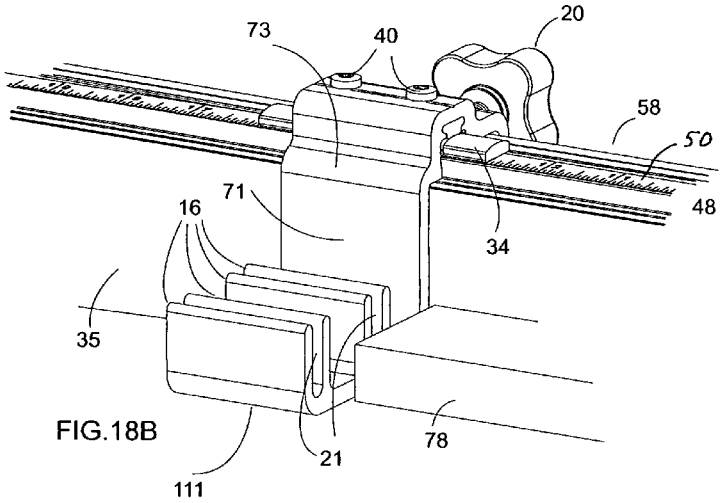
FIG.18B
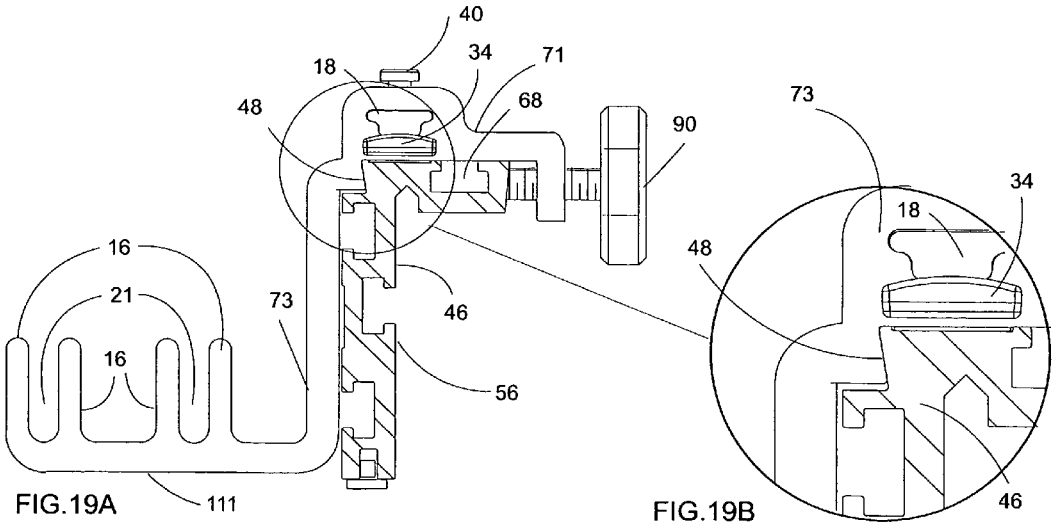
FIG.19A
FIG.19B

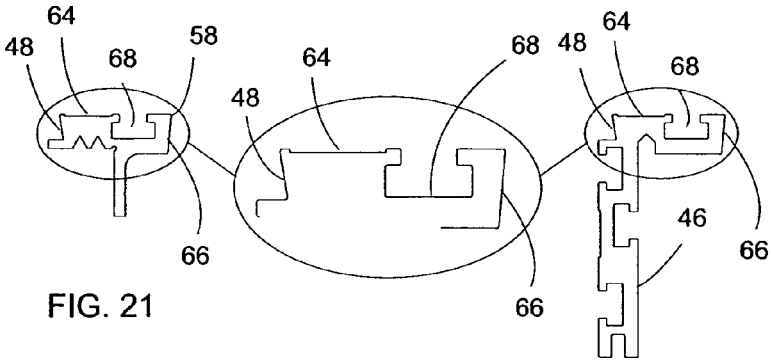
FIG. 21
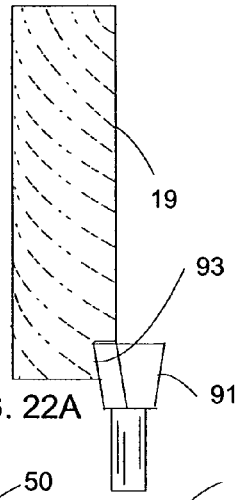
FIG. 22A
FIG.20C
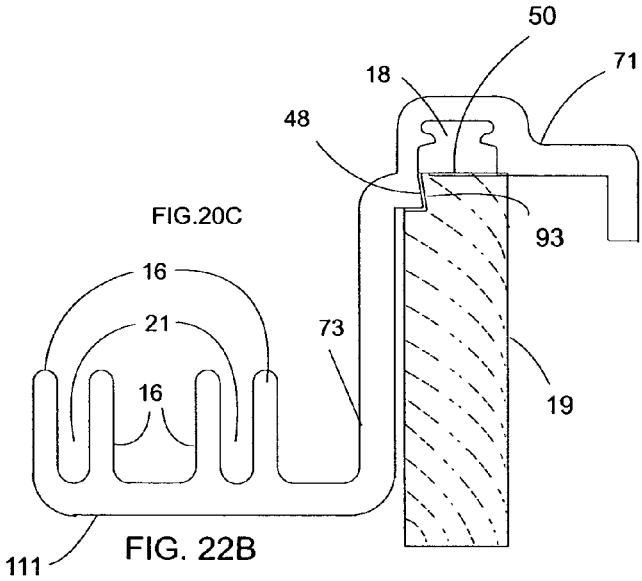
FIG. 22B
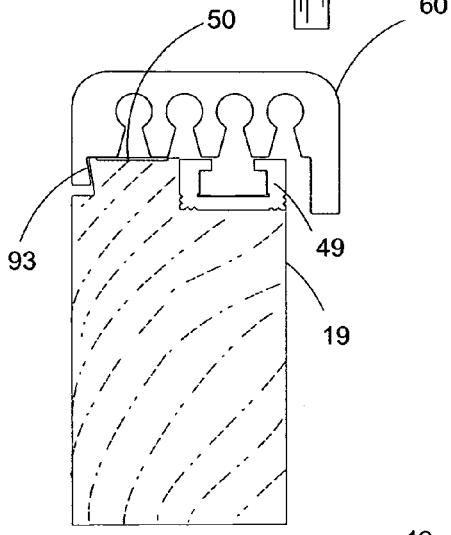
FIG. 22C
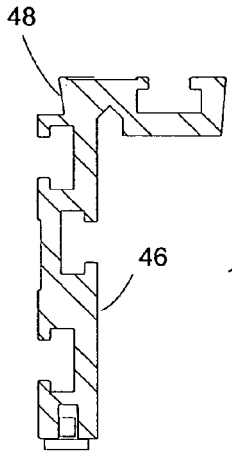
FIG. 23A
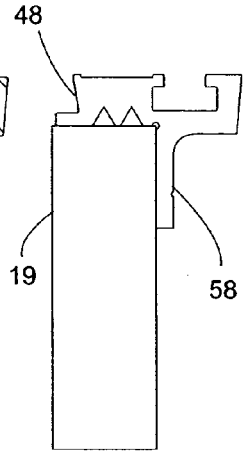
FIG. 23B
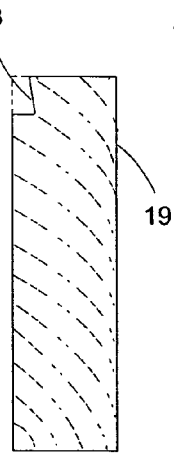
FIG. 23C
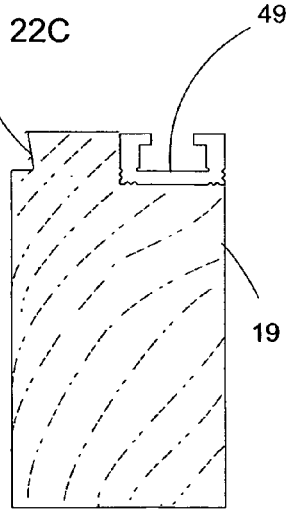
FIG. 23D

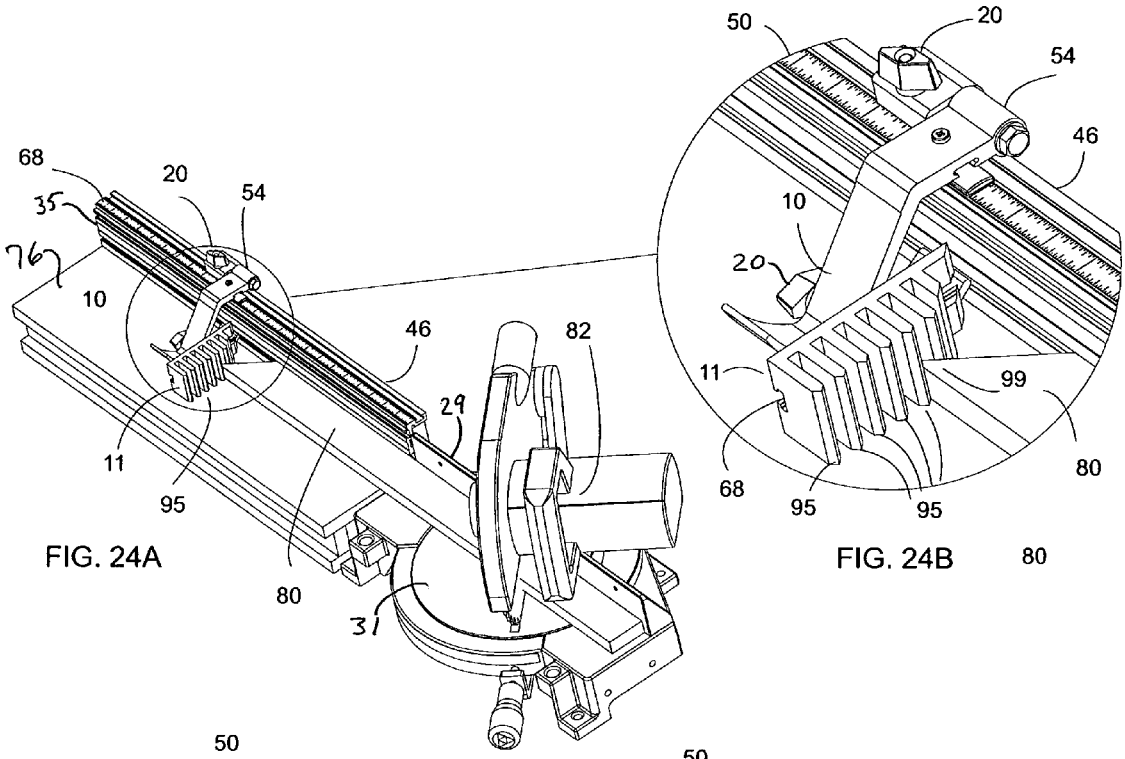
FIG. 24A
FIG. 24B
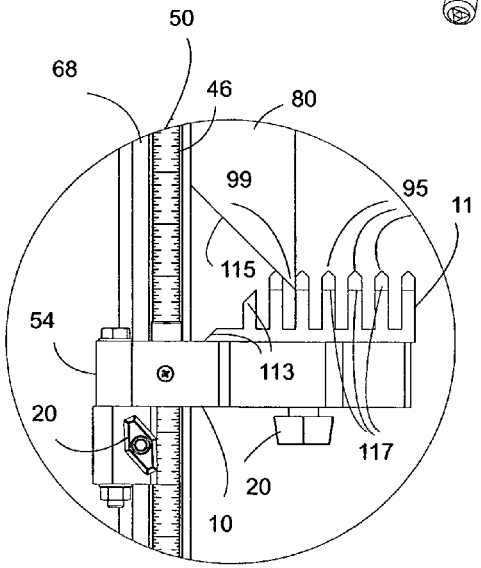
FIG. 24C
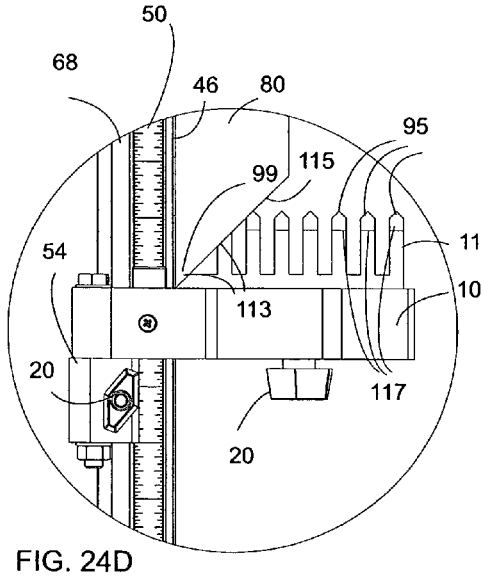
FIG. 24D

WOODWORKING MACHINERY STOP AND TRACK SYSTEM

CROSS REFERENCE TO RELATED APPLICATION

This claims the benefit of U.S. Provisional Patent Application No. 60/503,609 filed Sep. 17, 2003.

FIELD OF THE INVENTION

This invention relates to shop made jigs and fixtures for positioning, aligning, guiding, and/or holding a workpiece on metalworking or woodworking machines during a cutting or shaping operation.

BACKGROUND OF THE INVENTION

U.S. Pat. Nos. 5,337,641, 5,617,909, and 5,768,966, the disclosures of which are hereby incorporated by reference, disclose improved jigs and fixtures for aligning, guiding, and/or holding a workpiece as it is worked, for example as it is cut, drilled, or routed. While the jigs and fixtures disclosed in U.S. Pat. Nos. 5,337,641, 5,617,909, and 5,768,966 represent a significant advance in the art, room still exists for improvements, particularly in the following respects, among others.

Stops are typically secured in a T-slot of a track There is always a slight variation in the extrusion which compromises the fit. There is no stop base that fits a variety of T-slots that can be located and be removed from the track between two adjacent stops. U.S. Pat. No. 5,337,641 teaches that the stop can be bolted in the down position but this requires threading a bolt through the stop into the base, which is tedious. None of the stops available are designed to allow cutting a miter with either the point in or the point out without any manipulation. Expensive stop systems have large and complicated accessories for supporting the point of a miter.

None of the stops available are designed to accommodate fences of various heights. There is no after market flip stop available with a magnifier lens. There is no after market flip stop that has a mechanism for adjusting the length of the stop so that it can be used with fences of different heights. None of the stops available are designed to accommodate a removable fixture by simply loosening one knob.

SUMMARY OF THE INVENTION

The invention provides an improved woodworking machinery jig and fixture system that has a stop with a half-dovetail surface. One or more T-slots may also be provided in the stop, and the stop may be a flip stop or a fixed stop. The half-dovetail surface can be clamped against a half-dovetail surface on the support, or against a flat surface, to secure the stop to the support.

In another aspect, the base of a stop has multiple through holes, any one of which can be used to mount a flip stop arm so as to vary the height of the arm or use a zero clearance fence.

In another aspect, a track for the system has a flange that helps locate the track along the rear corner of a wood fence. The flange also helps secure the track to the wood fence with fasteners through holes that can be drilled in the flange using a drill guide groove formed in the flange.

In another aspect, tension screws are provided in the stop and in the base for eliminating play between the hinge pin, the flip stop and the base.

In another aspect, the support has a ruler on its top surface that faces up. In this aspect, a lens may be received in a groove of the stop arm. The lens extends from the stop arm in position to view the ruler from above the support.

In another aspect, the projection on the bottom of the base that fits into a T-slot is bordered by an angled surface that cams against the corner of the T-slot to push the other edge of the projection against the other corner of the T-slot when the base is assembled to the track, to provide a snug fit between the base and the track.

A fixed stop with a half-dovetail surface, lens groove and accessory mounting slots can be mounted to a standard 2×4 that has a mating half-dovetail surface or a flat surface.

A miter fixture can be mounted to the accessory slots that has fingers with ends that provide surface support of the mitered end of a workpiece whether the workpiece is supported with its point toward or away from the working plane of the support.

These and other objects and advantages of the invention will be apparent from the detailed description and drawings.

BRIEF DESCRIPTION OF THE DRAWINGS

FIG. 5A is a perspective view of the curved flip stop and heavy duty flip stop positioned on the top track as it is used on a miter saw.

FIG. 5B is an end view of a top track shown in FIG. 5A showing a drill bit through the back mounting flange.

FIG. 5C is a detail view of FIG. 5B showing the drill guide indentation in the back mounting flange.

FIG. 6A is an end view of a top track and the flip stop as it is used on a miter saw, with screws through the back mounting flange of the top track securing the track to the upper edge of the auxiliary fence.

FIG. 6B is an detail view of FIG. 6A showing a screw through the back mounting flange of the top track securing it to the upper edge of the auxiliary fence.

FIG. 7A is a detail view of the top profile of the track which is common to both the L-shaped track shown in FIG. 1B and the top track shown in FIG. 5B.

FIG. 7B is a detail view of the L-shaped track shown in FIG. 1B.

FIG. 7C is a detail view of the top track as shown in FIG. 5B.

FIG. 8A is a perspective view of the curved flip stop and the top track as it is used on a miter saw fence.

FIG. 8B is an end elevation view of certain components of the system of FIG. 8A.

FIG. 8C is an exploded view of certain components of the system of FIG. 8A.

FIG. 8D is a detail view of the lens and stick-on tape of FIG. 8C.

FIG. 9A is a top view of FIG. 8A showing the flip stop mounted on the track.

FIG. 9B is a detail view of FIG. 9A showing the stick-on tape as it is seen through the lens (not showing magnification, although it would be magnified in actual practice).

FIG. 18A is a perspective view of a fixed stop positioned on a top track as it is used on a miter saw.

FIG. 18B is a detail view of FIG. 1A showing the stick-on tape and the lens.

FIG. 19A is an end view of the fixed stop positioned on the L-shaped track.

FIG. 19B is a detail view of FIG. 19A showing a half-dovetail on the fixed stop positioned against the half-dovetail on the front of the L-shaped track.

FIG. 21 is a detail view of the top profile of the track which is common to both the L-shaped track and the top track showing the dovetail required for the fixed stop and the heavy duty flip stop.

FIG. 22A shows a dovetail router bit cutting a half-dovetail shape in a board.

FIG. 22B is an end view of the fixed stop aligned with the half-dovetail shape cut in a ¾" wide board.

FIG. 22C is an end view showing the heavy duty flip stop base aligned with the half-dovetail shape cut in a 1½" board such as a 2 by 4.

FIG. 23A is an end view of the L-shaped track shown with a plastic bumper on the bottom which makes the total height 2¾".

FIG. 23B is an end view of the top track shown screwed to a 2⅜" by ¾" board making the total height 2¾".

FIG. 23C is an end view of the ¾" board shown in FIG. 22B.

FIG. 23D is an end view of the board shown in FIG. 22C shown with an optional piece of mini-track in the back corner which would allow the use of the flip stop.

FIG. 24A is a perspective view of the flip stop positioned on the top track as it is used on a miter saw, with a miter fixture attached to the flip stop.

FIG. 24B is a detail view of the flip stop and miter fixture shown in FIG. 24A.

FIG. 24C is a top view of the flip stop and miter fixture as shown in FIG. 24A.

FIG. 24D is a top view of the flip stop and miter fixture as shown in FIG. 24A with the point of the mitered board against the fence.

DETAILED DESCRIPTION OF THE PREFERRED EMBODIMENT

Figure 1A:
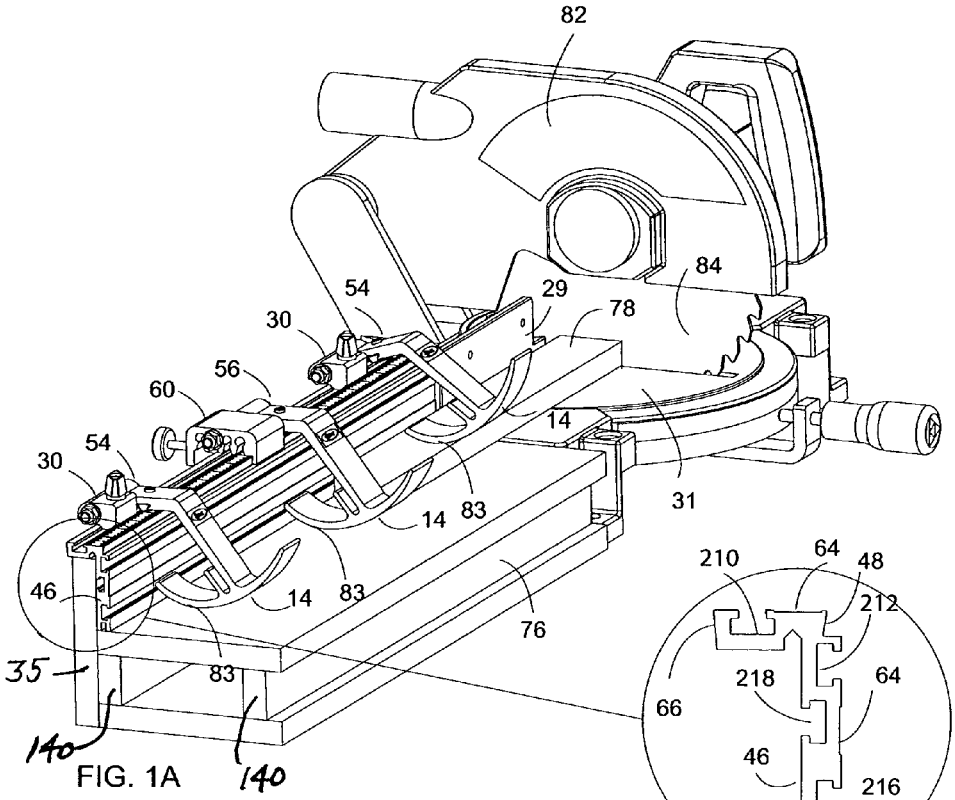
FIG. 1A is a perspective view of a curved flip stop and a heavy duty flip stop positioned on an L-shaped track as it is used on a miter saw.

FIG. 1A illustrates a track of the invention 46, shown together with a flip stop 54 and a heavy duty flip stop 56 which are pivotable about the axis of a bolt 26 as disclosed in U.S. Pat. Nos. 5,337,641 and 5,768,966, the entire disclosures of which are hereby incorporated by reference for their teachings of how to make and use jigs and fixtures. The drawing is a perspective view of two flip stops 54 with a heavy duty flip stop 56 positioned between them. The stops are positioned on the L-shaped track 46 as it is used on a miter saw 82. The work piece 78 rests on the miter saw table auxiliary table 76 with one edge against the miter saw fence 29 and miter saw auxiliary fence 35. A wood shop-made extension table 76 is the same height as the miter saw table 31 so the work piece 80 lays flat on both tables. The extension table 76 is supported by two legs 140. A wood auxiliary fence 35 is mounted on the back of the wood shop made extension table 76. The L-shaped track 46 is an L-shaped extrusion with multiple T-slots 210, 212, 216, 218 which is attached to the front side of the wood auxiliary fence 35. To cut a piece accurately to width the end of the work piece 78 is pressed against the stop arm 10 (FIG. 2A) while the other end is cut with the blade 84. When the flip stop assembly 54 or the heavy duty flip stop assembly 56 is not in use the flip stop arm 10 can rest on top of the work piece 78 in the stand by position 62 (FIG. 2B).

Figure 1B:
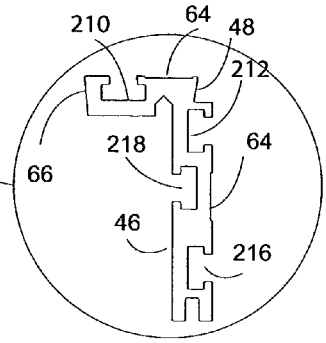
FIG. 1B is an end view of the L-shaped track shown in FIG. 1A.

FIG. 1B is an end view of the L-shaped track 46 shown in FIG. 1A. The back top T-slot 210 is the mechanism for attaching the flip stop assembly 54. This track is similar to the L-shaped track of the U.S. Pat. No. 5,768,966 with two new improvement features. One improvement is that the front top T-slot of the U.S. Pat. No. 5,768,966 has been replaced by a half-dovetail 48 which is the mechanism used to attach accessories to the top of the track such as the heavy duty flip stop 56 shown in FIG. 1A and the fixed stop 71 show in FIGS. 18A, 18B, 19A, 20A, 20B, 20C, 20D. The half-dovetail 48 has a 9 degree angle which is a standard router bit angle for making a standard dovetail joint. There is also a 5 degree angle 66 at the back of the track which helps to keep the accessories such as the heavy duty flip stop 56 and the fixed stop 71 from rotating upward. In other words, it biases the stop downwardly when the thumb screw 20 or other fastener that fixes the stop to the track is tightened against it (FIG. 4B).

Also replacing the top front T-slot of the U.S. Pat. No. 5,768,966 is a 0.520" indentation for a stick-on tape 64 on the front of the L-shaped track 46. The stick-on tape 50 on the top of the L-shaped track 46 is better for use on the miter gauge because the user does not have to lean over the miter gauge to see the measurement. It also avoids the problem of parallax when viewing the tape against the edge of the stop.

Figure 2A:
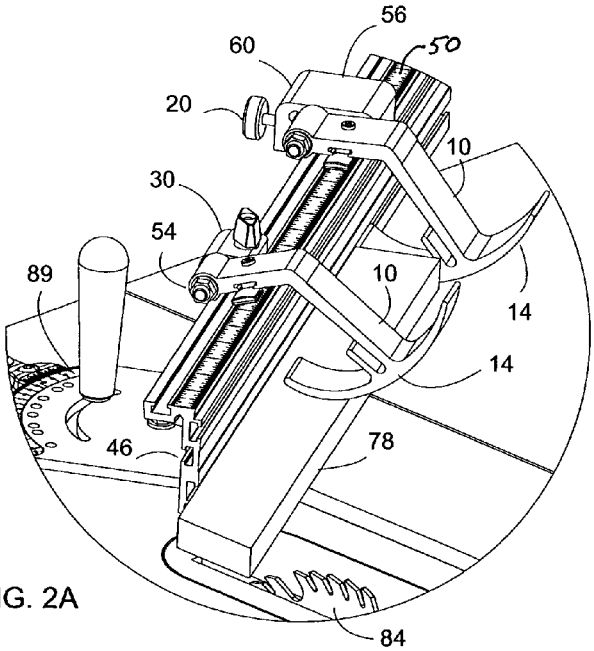
FIG. 2A is a perspective view of the curved flip stop and heavy duty flip stop positioned on the L-shaped track as it is used on a table saw miter gauge.
Figure 2B:
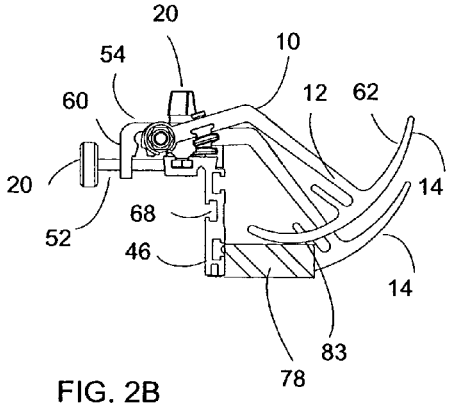
FIG. 2B is an end view of an L-shaped track and stops shown in FIG. 2A.

FIG. 2A is a perspective view of the flip stop 54 and heavy duty flip stop 56 positioned on the L-shaped track 46 as it is used on a table saw miter gauge 89. The flip stop assembly 54 and the heavy duty flip stop assembly 56 is used to crosscut boards to length by measuring the distance between the end of the board 78 and the saw blade 84. The end of the board is pressed against the stop arm 10 while the other end is cut with the blade 84. When the flip stop assembly 54 or the heavy duty flip stop assembly 56 is not in use the flip stop arm 10 can rest on top of the work piece 78 in the standby position 62. The flip stop assembly 54 is slideable along the length of a track by loosening knob 20 to loosen the head of the bolt 26 (not shown) which slides in the top T-slots 64 of the track 46. The exact distance between the saw blade 84 and a stop can be measured with the stick-on-tape 50 attached to the L-shaped track 46. The flip stop arm 10 of the flip stop assembly 54 rests on the top of the workpiece 78 in the standby position 62.

FIG. 2B is an end view of the L-shaped track and stops shown in FIG. 2A, illustrating the standby position 62 and also the work position in which the arm 10 is lowered so that the end of the workpiece 78 can engage it.

Figure 3A:
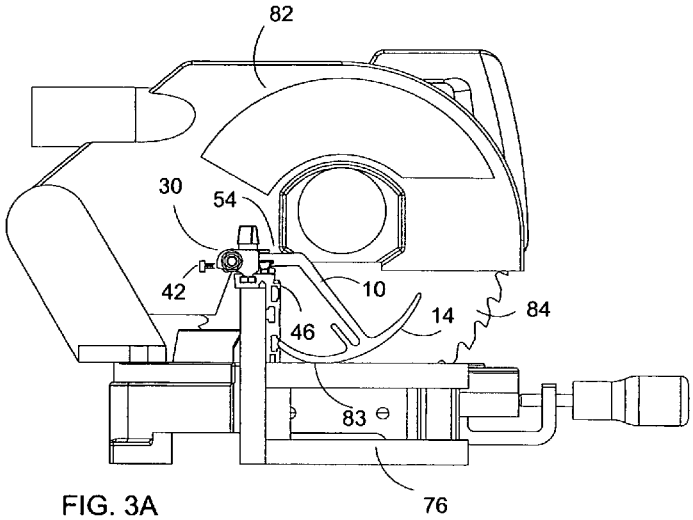
FIG. 3A is an end view of an L-shaped track and a flip stop as it is used on a miter saw.
Figure 3B:
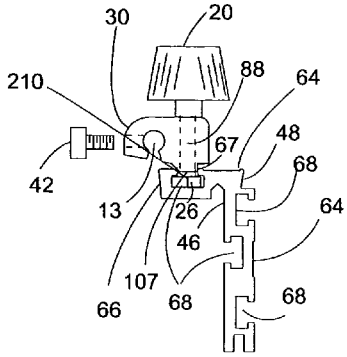
FIG. 3B is a close up end view of the curved flip stop base positioned on the L-shaped track.
Figure 10A:
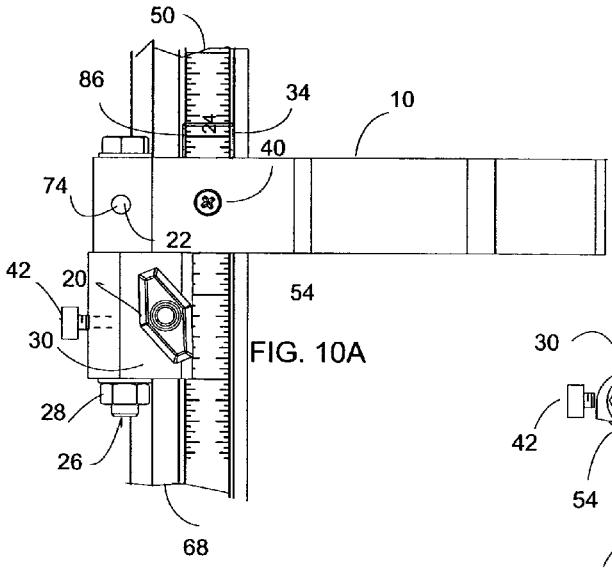
FIG. 10A is a top view of the flip stop system showing the flip stop mounted on the top track.
Figure 10D:
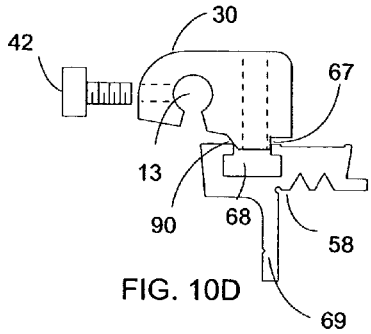
FIG. 10D is a detail view of FIG. 10B showing the flip stop base engaging the T-slot of the top track.
Figure 10E:
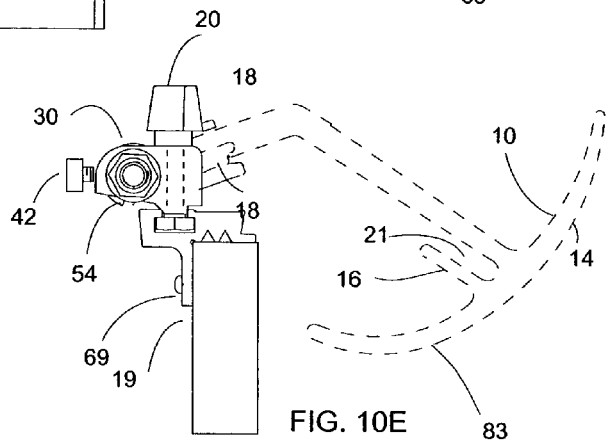
FIG. 10E is an end view of the system showing the flip stop mounted on the top track with the stop arm in the standby position as it would be when resting on the workpiece.
Figure 10B:
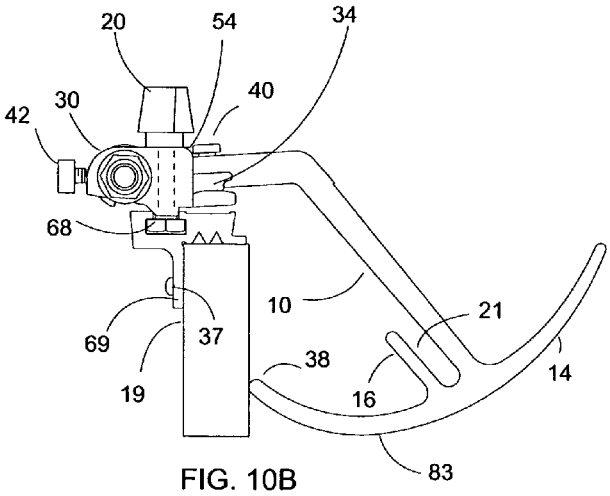
FIG. 10B is an end view of the flip stop system showing the flip stop mounted on the top track.
Figure 10C:
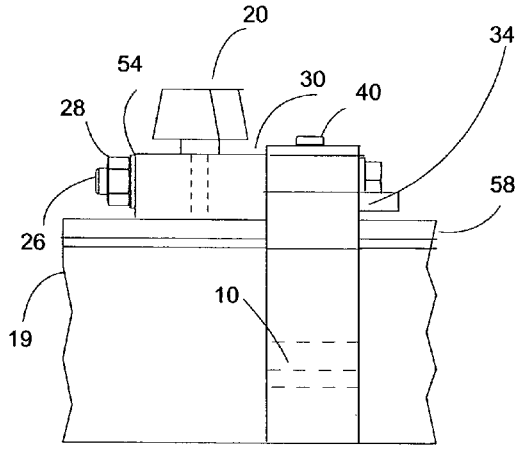
FIG. 10C is a front view of the flip stop system showing the flip stop mounted on the top track.

FIG. 3A is an end view of a L-shaped track and a flip stop as it is used with a miter saw and FIG. 3B is a detail end view of the flip stop base 30, preferably extruded aluminum, positioned on the L-shaped track 46, also preferably extruded aluminum. The flip stop assembly 54 is attached to the L-shaped track 46 T-slot 112 with the bolt 26 which is locked in place by the knob 20 which is shown in the exploded view in FIG. 8C. The base 30 has a bottom protrusion 107 which extends laterally along the bottom side of the base 30 and fits into the T-slots 68 of the track to help guide the base and prevent it from rotating relative to the track. The protrusion 107 has a downwardly facing surface that is bordered at its rear edge by an angled surface 90 (FIGS. 8B and 10D) and at its front edge by a right angle step 67. The angled surface cams against the rear edge of the T-slot 68 to push the step 67 against the opposite side of the T-slot 68 when the thumb nut 20 (FIG. 3B) is tightened, to eliminate any clearance between the T-slot and the protrusion 107. The T-slot 68 is designed to take the head of a ¼-20 bolt 26 as is standard.

Figure 4A:
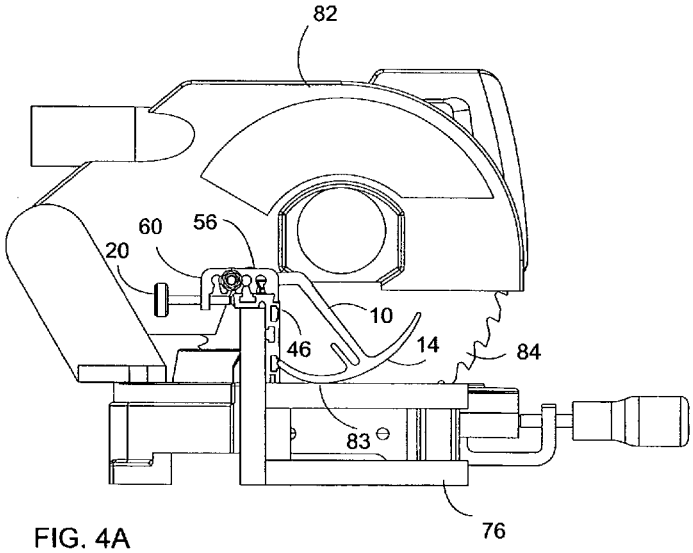
FIG. 4A is an end view of an L-shaped track and a heavy duty flip stop as it is used on a miter saw.
Figure 4B:
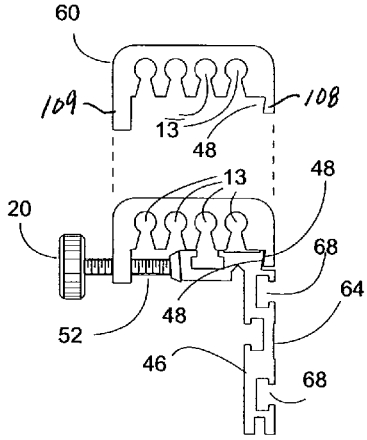
FIG. 4B is a detail end view of the heavy duty flip stop base positioned on the L-shaped track.

FIG. 4A illustrates the heavy duty flip stop 56 with the miter saw and FIG. 4B is a detail end view of the heavy duty flip stop base 60 positioned on the L-shaped track 46. The heavy duty flip stop base 60 is preferably an extruded aluminum block with four 5/16" holes 13 and two downward protrusions 108 and 109. The protrusion 108 at the front is flush with the front of the track extrusion. The inside of the front downward protrusion 108 is a 9 degree half-dovetail surface 48. The 9 degree half-dovetail 48 on the inside of the front downward protrusion 108 corresponds to the same angle at the front of the L-shaped track 46. The heavy duty flip stop base 60 is secured to the L-shaped track 46 with swivel head stud 52 with a knob 20 secured to the end of it, the stud 52 being threaded into a hole in the protrusion 109. The rotating end of the swivel head stud 52 presses against the 5 degree angled surface 66 at the back of the top track extrusion 58, which pulls the base 60 rearwardly and downwardly for a stable connection with the track. As the knob 20 is rotated, the 9 degree half-dovetail 48 on the L-shaped track 46 engages with the half-dovetail surface 48 on the heavy duty flip stop base 60. This design allows the heavy duty flip stop base 60 to easily be loosened from the track and lifted off the track, and re-assembled to the track from above, for example inside of a stop that is already assembled to the track. This solves the problem of mounting the flip stop 54 to the T-slot 68 which requires that it be slid off the end of the track rather than simply loosening a knob and then lifting it off the track.

FIG. 5A illustrates a top track 58 (preferably extruded aluminum) applied to a miter saw 82 and FIG. 5B is an end view of the top track 58 shown in FIG. 5A showing a drill bit through the back mounting flange 69. An indentation line or groove 70 is extruded into the back mounting flange 69 that acts as a drill guide to make it easy to drill holes in the extrusion 110 along a straight line so it can be screwed to the edge of the wood auxiliary fence 35, along the rear corner of the fence 35. The back mounting flange 69 eliminates the need for aligning the track on top of the fence 35 as the rear corner bearing against the bottom of the track 58 and the flange 69 automatically aligns it. The 9 degree half-dovetail 48 on the front of the track 58 and the 5 degree angled surface 66 at the back of the track allow the use of quick release stops such as the heavy duty flip stop assembly 56 and the fixed stop 71 (FIG. 18B).

FIG. 7A is a detail view of the top profile of the track which is common to both the L-shaped track shown in FIG. 1B and the top track shown in 5B. Both of the tracks share the 9 degree half-dovetail 48 at the front of the track, indentation for a stick-on tape 64, T-slot 68 and the 5 degree angled back 66, which may also be considered a half-dovetail surface, although not at the standard 9 degrees that is uniform for woodworking dovetails and a standard size for a woodworking dovetail router bit.

FIG. 8A is a perspective view of the top track 58 screwed to wood fence 35 to make a woodworking support of the invention and FIG. 8B is an end elevation view of certain components of the system of FIG. 8A, including the three custom made extrusions for the track 58 and the stop assembly 54. The stop arm 10 (preferably extruded aluminum) is generally T-shaped with curved bottom 14 that has a 3 inch radius 81 (FIG. 17) that changes gradually to a curve 83 with a 2.25 inch radius 87 having its center below the center of the radius 81, so that the end 38 will be high enough to fit into the lowest T-slot 216 in the front of the L-shaped track 46, so as to penetrate the working plane of the track so as to stop a pointed workpiece with the point adjacent to the working plane. The bottom curves 14 and 83 curve away from the machine table so that the arm 10 can be easily lifted by sliding a workpiece under the surfaces 14 and 83.

A straight support arm 12 that is angled at approximately 35 degrees intersects near the middle of the curved bottom or shoe at a point so that the end of the surface 14 is high enough to permit sliding a thick board (e.g., 1.5 inch thick or more) while providing a shallow angle between the surface 14 and the top front edge of the board so that the arm 10 will be easily lifted when the board is slid under it. The arm 10 is also preferably made of relatively thin sections to keep the weight down, which also makes lifting easier.

Extending from the curved bottom 83 is a small finger 16 that is parallel to the straight support arm 12. The ¼" laterally extending space 21 between the straight support arm 12 and the finger 16 is fixture mounting slot 21, which extends parallel to the working plane of the woodworking support. A fixture can be mounted simply by sliding a ¼" bolt that mounts the fixture in the fixture mounting slot 21 (See FIGS. 24A-D). A transparent plastic magnifying lens 34 slides into the lens opening slot 18 and is secured in place by the lens locking screw 40 that is secured into a threaded hole 74. This mechanism allows the position of the lens to be fine tuned for accuracy.

The 5/16" hole 13 in the curved flip arm extrusion 10 is the standard plus or minus 0.015" accuracy of an aluminum extrusion. Usually holes in extruded aluminum are designed to be oversized so that when the extrusion die wears from use the hole in the extrusion is still within tolerance. Standard bolts vary in size. The lack of a tight fit between the hole and the bolt allows the flip stop arm to rotate laterally or transversely slightly compromising accuracy. To remove any sloppiness between the curved flip arm extrusion 10 and the bolt a threaded hole 74 is made in the extrusion and an arm tension set screw 22 (steel or plastic) is used to tighten against the bolt in the 5/16" hole 13 in the curved flip arm extrusion 10, to eliminate any clearance.

To remove any sloppiness between the base extrusion 30 and the bolt a threaded hole 74 is made in the back of the base extrusion 30. A base tension screw 42 is used to tighten the bolt in the 5/16" hole 13 in the base extrusion 30. The preferable material for the base tension screw 42 is nylon which is quite lubricious when the bolt rotates against it, since the bolt 42 turns as it acts like a hinge pin when the flip stop is raised and lowered. This tightening mechanism does not require tools and is easily adjusted with the operator's fingers.

FIG. 8C is an exploded view of certain components of the system of FIG. 8A. FIG. 8D is a detail view of the lens and stick-on tape of FIG. 8C. As shown in FIG. 8A the lens is designed to be positioned closely to the stick-on tape 50, above it. The lens 34 is clear plastic and magnifies the ruler. Located on the bottom of the lens is a red curser line 86. The red color allows the viewer to instantly identify the reference line. The red curser line 86 is usually positioned about ¼" away from the edge of the stop arm which means that the stick-on tape 50 is offset ¼". The lens locking screw 40 mechanism allows for the fine adjustment of the red curser line 86.

No known aftermarket flip stop design has a lens. In the original U.S. Pat. No. 5,337,641, the stop was L-shaped and the stick-on tape 50 was adjustable. The measurement was read off the edge of the stop using the cut edge of the extrusion as the reference point. Because the back of the stop is close to the stick-on tape 50, there was problem fine tuning the set up because only half of the ruler was visible because the other half is covered by the stop arm. The problem is solved by locating the indentation 64 for a stick-on tape 50 in the top of the front corner of the top track 58 and the L-shaped track 46 as seen in FIGS. 9A and 1B respectively and by locating the lens 34 directly above the stick-on tape 50 as shown in FIG. 9B. The measurement is readily visible as the viewer can see both sides of the desired setting on the stick-on tape 50 versus only one side which is the case in the U.S. Pat. No. 5,337,641. The measurement setting is easily seen for either the table saw user, who views it from the back of the track, or the miter and radial saw user who views the tape from the front.

Figure 11A:
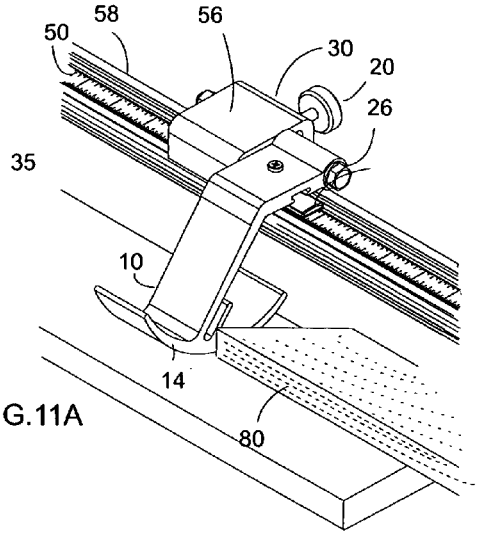
FIG. 11A is a perspective view of the heavy duty flip stop and the top track.
Figure 11D:
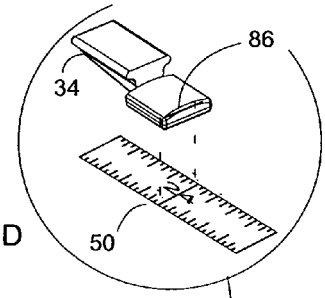
FIG. 11D is an exploded view of certain components of the system of FIG. 11C.
Figure 11B:
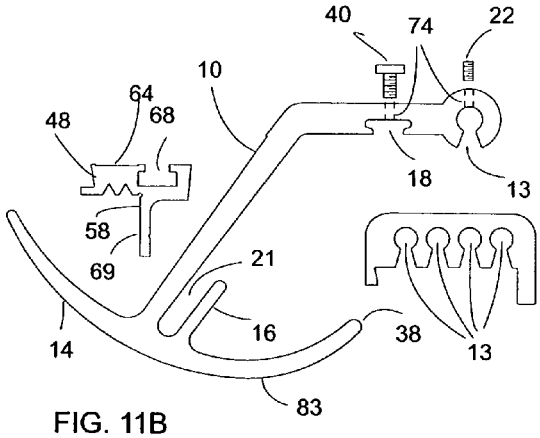
FIG. 11B is an end elevation view of certain heavy duty flip stop components of the system of FIG. 11A.

FIG. 11A is a perspective view of the heavy duty flip stop and the top track. The bottom curve 14 of the curved flip stop arm 10 is wide enough to engage the end of a mitered board that is ¾" by 2¼" with the point of the miter opposite the fence 35. Positioning the point of the miter away from the fence is ideal because the force of the blade cutting the miter on the opposite end applies a uniform pressure against the stop guaranteeing that all of the work pieces will be cut at a uniform length. If the piece to be mitered is wider than 2¼" a fixture can be attached to the curved stop arm 10 by using the fixture mounting slot 21. FIG. 11B is an end elevation view of certain heavy duty flip stop components of the system of FIG. 11A.

Figure 11C:
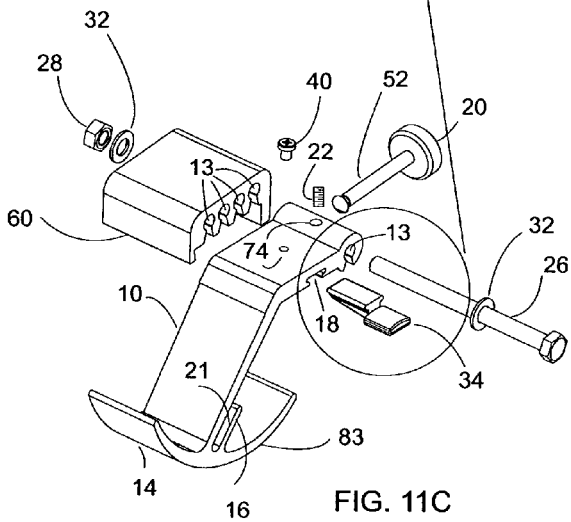
Figure 12A:
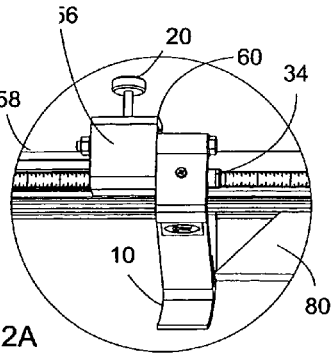
FIG. 12A is a perspective view of FIG. 11A showing the heavy duty flip stop mounted on the track.
Figure 12B:
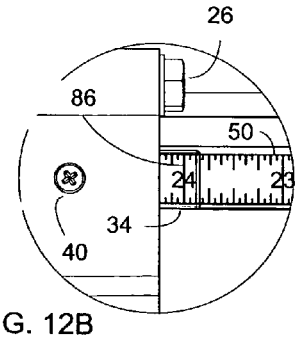
FIG. 12B is a detail view of FIG. 12A showing the stick-on tape as it is seen through the lens (not showing magnification).
Figure 13A:
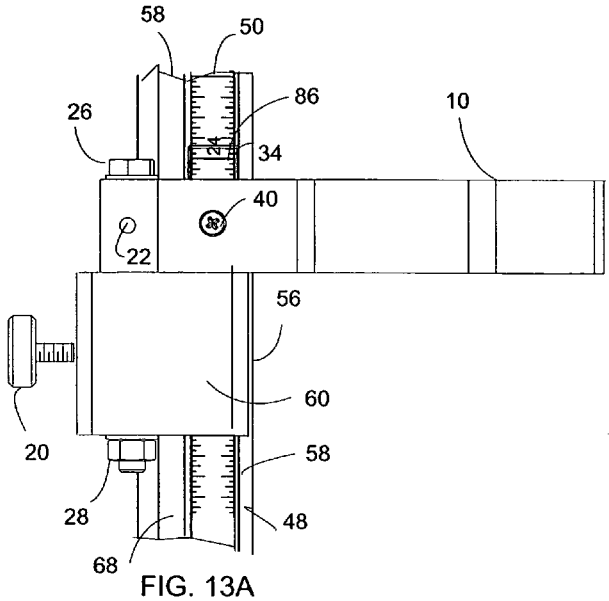
FIG. 13A is a top view of the system showing the heavy duty flip stop mounted on the top track.
Figure 13B:
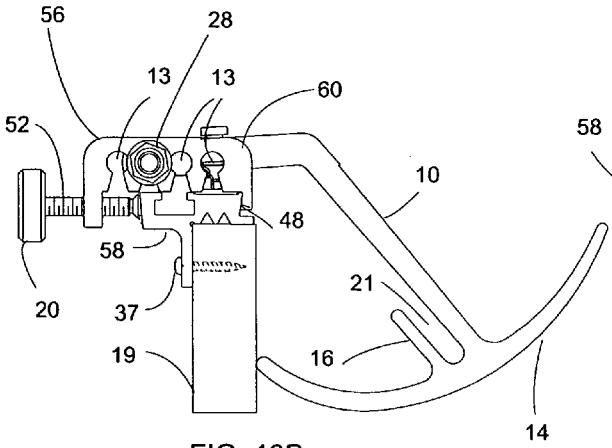
FIG. 13B is an end view of the system showing the heavy duty flip stop mounted on the top track.
Figure 13C:
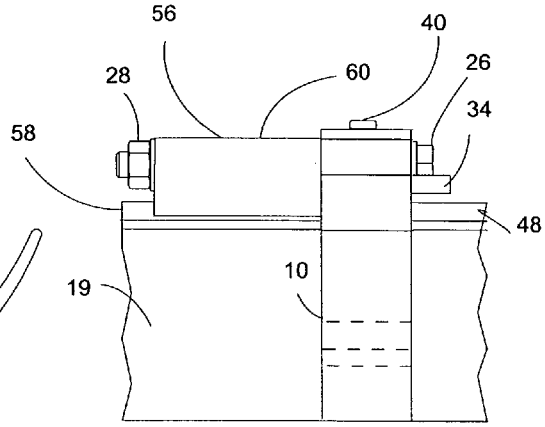
FIG. 13C is a front view of the system showing the heavy duty flip stop mounted on the top track.
Figure 14:
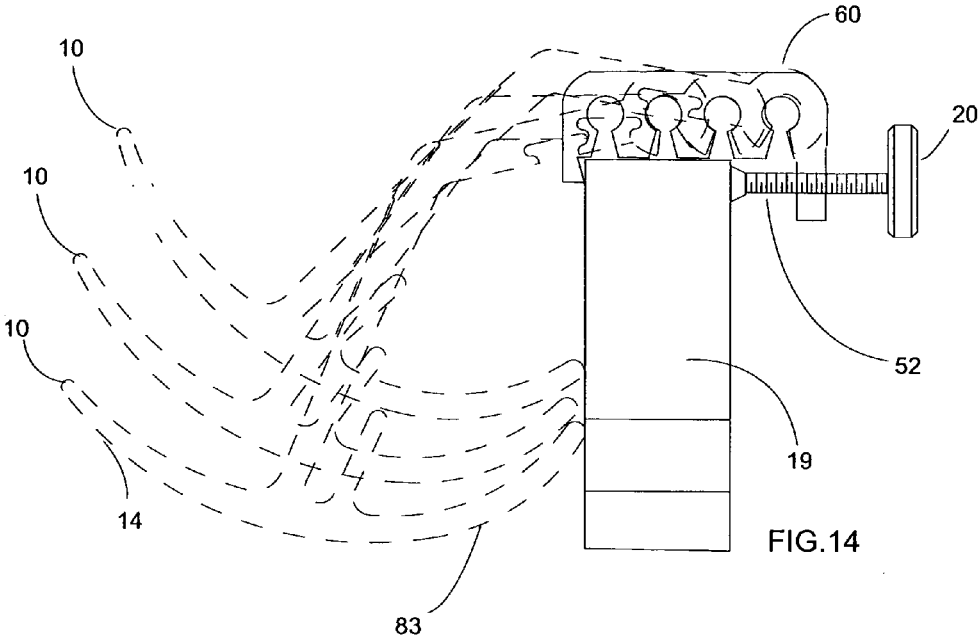
FIG. 14 is an end view of the heavy duty flip stop base mounted on a board showing that the height of the flip stop arm changes when the hole in the flip stop arm extrusion is aligned with different holes in the heavy duty flip stop base.
Figure 15:
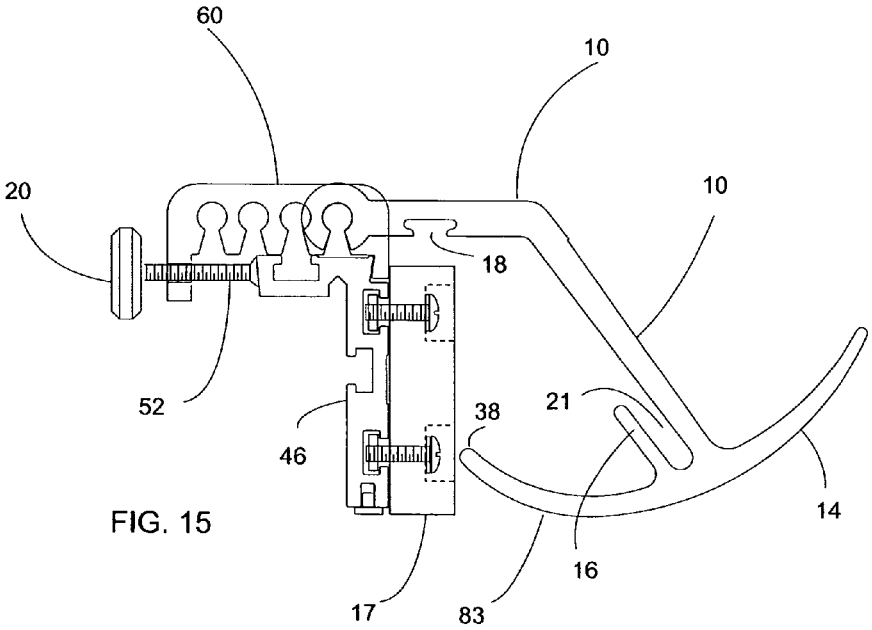
FIG. 15 is a side view of the heavy duty flip stop components mounted on the L-shaped track. The arm extrusion is aligned with the front hole of the base allowing space between the arm and the track for attaching a zero clearance board 17.
Figure 16:
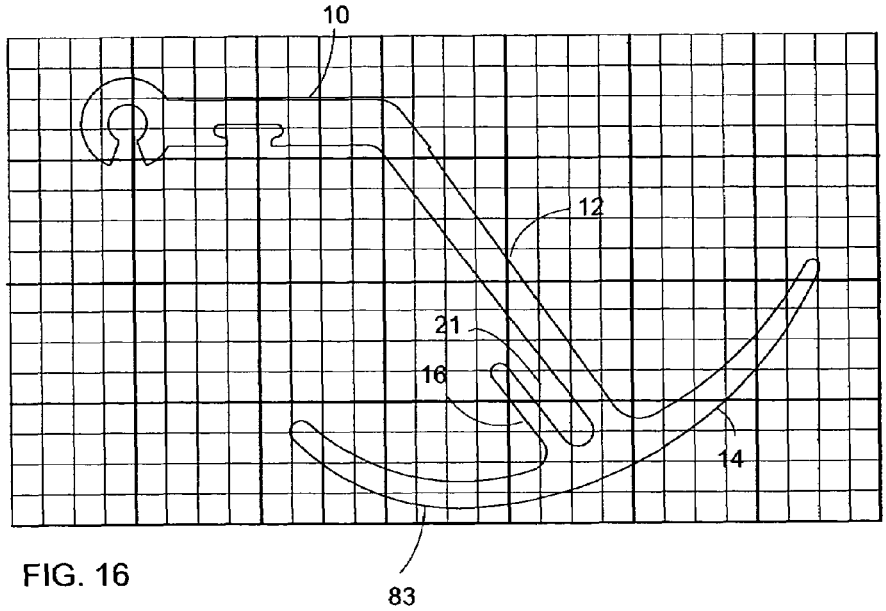
FIG. 16 is a side view scale drawing of the flip stop arm shown on a ¼" grid.

FIG. 11C is an exploded view of certain components of the system of FIG. 11A. The curved flip arm extrusion 10 is the same for both the flip stop assembly 54 and the heavy duty flip stop assembly 56. A feature that the heavy duty flip stop assembly 56 has is the ability to be configured so that it can be used on machine fences of different height as shown in FIG. 14. By changing the hole 13 that the arm is bolted through the height of the curved flip arm extrusion 10 in front of the woodworking support changes. FIG. 15 shows that locating the bolt in the front hole 13 allows enough room between the L-shaped track 46 and the point 38 at the back of the flip arm 38 so that a zero clearance fence 17 (a board that can be cut into by the blade to support the workpiece right next to the cut) can be added to the front of the track.

Figure 17:
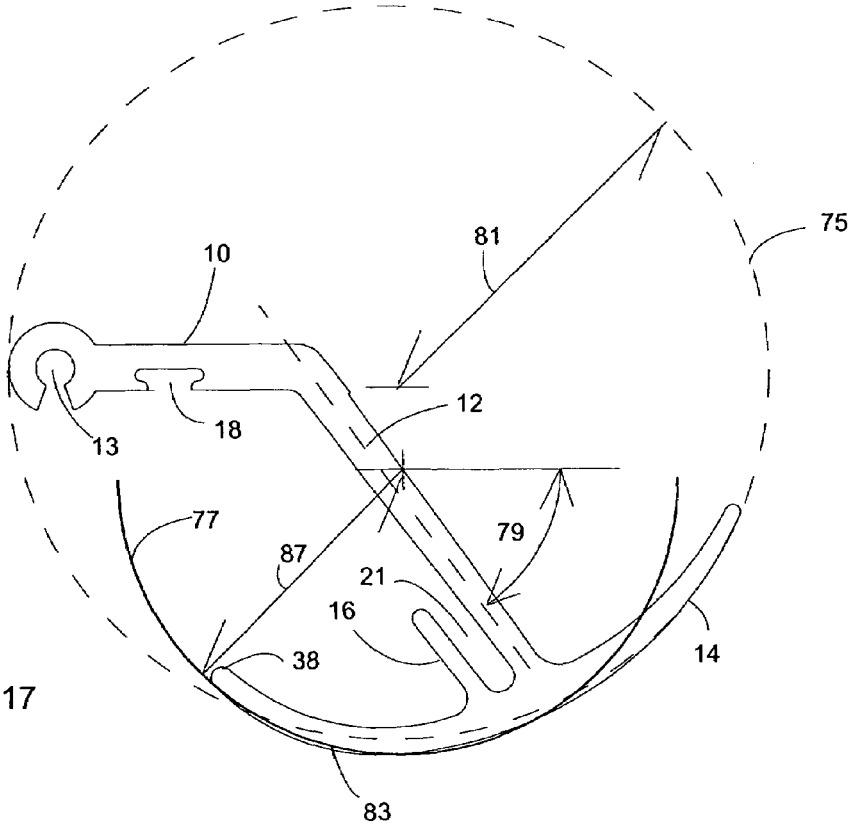
FIG. 17 is a side view scale drawing of the flip stop arm shown inside a 6 inch circle.
Figure 20A:
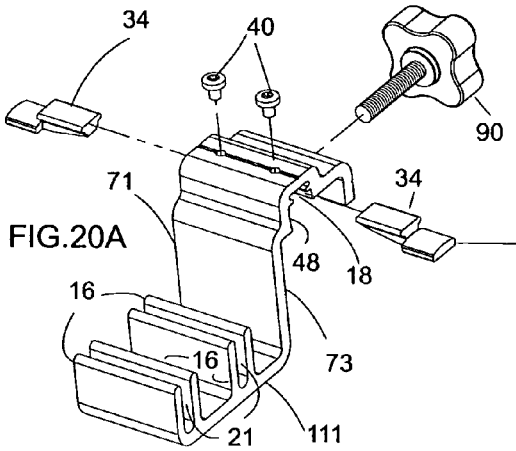
FIG. 20A is an exploded perspective view of the fixed stop.
Figure 20B:
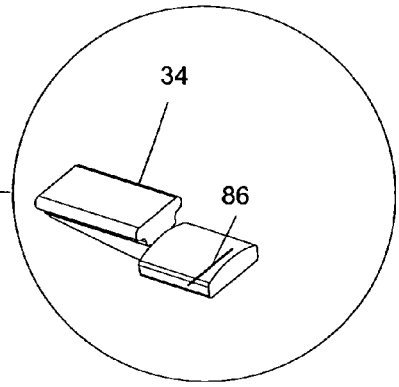
FIG. 20B is a perspective view of the lens.
Figure 20C:
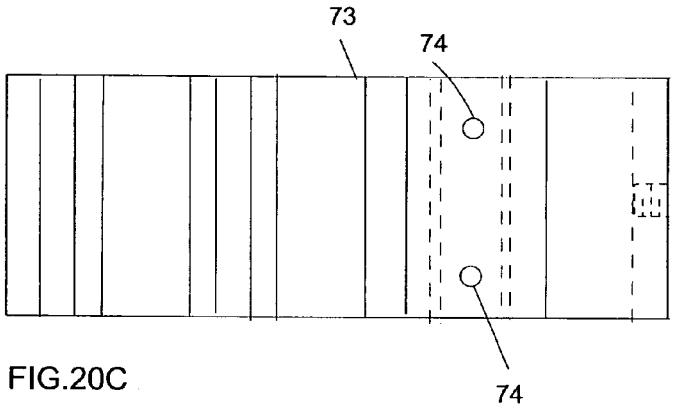
FIG. 20C is a top view of the fixed stop.
Figure 20D:
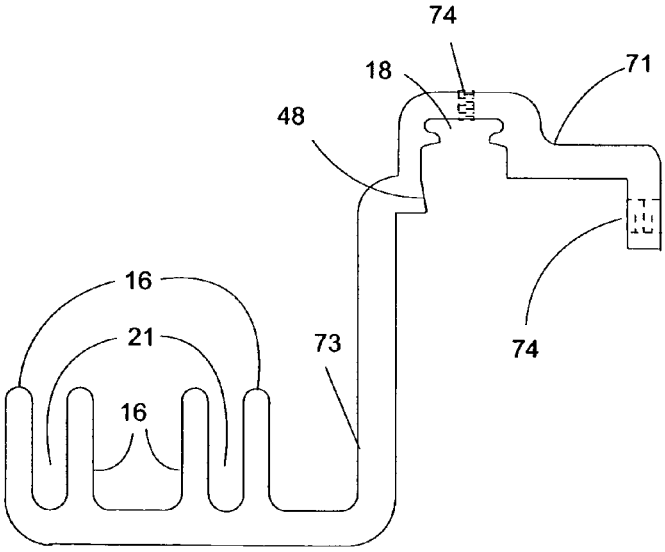
FIG. 20D is a side view of the fixed stop.
Figure 20E:
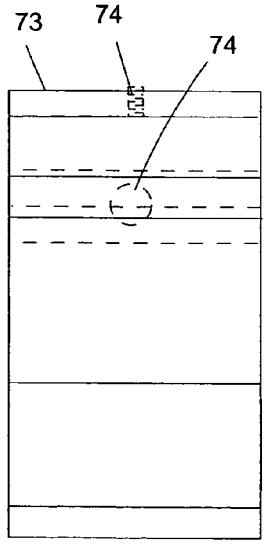
FIG. 20E is a front view of the fixed stop.

FIG. 17 is an end elevation view of the flip stop arm 10 showing a 6 inch diameter circle 75 that the flip stop arm 10 fits inside of. The front of the flip stop arm 14 has the 3 inch radius 81 of the 6 inch diameter circle 75. The curve at the bottom of the flip arm 83 is the size of a smaller 4.5 inch diameter circle 77 which has a 2.25 inch radius 87. A straight arm 12 angles toward the bottom of the stop at approximately a 35 degree angle 79 (relative to horizontal, with the arm supported with its upper leg that extends from arm 12 to attachment hole 13 horizontal) and attaches to the bottom of the stop arm 10 approximately where the 6 inch circle 75 and the 4.5 inch circle 77 intersect with each other.

FIG. 18A is a perspective view of the fixed stop positioned on the top track as it is used on a miter saw. FIG. 18B is a detail view of FIG. 18A showing the stick-on tape 50 and the lens 34. FIG. 19A is an end view of the fixed stop 71 positioned on the L-shaped track showing how the 9 degree half-dovetail 48 on the fixed stop and L-shaped track 46 mate with each other. The fixed stop 71 is locked to the L-shaped track 46 by the threaded stud knob 90 at the back of the stop. This is similar to the mechanism used by the heavy duty flip stop assembly 56. The fixed stop 71 is made from a one piece aluminum extrusion 73 that closely follows the profile of the L-shaped track 46 as shown in FIG. 19A. The extension leg 111, which is parallel to the machine table top extends the front of the fixed stop 71. This extension leg 111 allows the fixed stop 71 to be used with wide mitered boards. Four fingers 16 on the extension leg 111 create two fixture mounting slots 21. Jigs and fixtures are easily attached to the fixed stop 71 with a ¼" bolt located in the fixture mounting slots 21.

The 9 degree half-dovetail 48 design allows for a number of fence options besides the L-shaped track 46 and the top track 58. FIG. 22A shows a 9 degree dovetail router bit 91 making a 9 degree half-dovetail cutout 93 in a wood fence 19. FIG. 22B is an end view of the fixed stop 71 positioned on the wood fence 19 showing how the 9 degree half-dovetail 48 on the fixed stop 71 and a 9 degree half-dovetail cutout 93 in a wood fence 19 mate with each other (screw 90 not shown). Because the fixed stop 71 attaches to a fence by clamping pressure between the 9 degree half-dovetail and the threaded stud knob 90 it can be attached to materials of various widths. FIG. 22C shows the fixed stop 71 positioned on a wood 2 by 4 fence 19 which is an inch and a half thick. Construction material that is an inch and a half thick is common on building sights where contractors often build miter saw table extensions out of it. The fixed stop 71 would be useful for a builder on a job sight where multiple pieces of the same length are often cut.

FIG. 24A is a perspective view of the stop 54 positioned on the L-shaped track 46 as it is used on a miter saw 82. The mitered work piece 80 rests on the miter saw table auxiliary table 76 with one edge against the miter saw fence 29 and the other end against miter saw auxiliary fence 35. A wood shop made extension table 76 is the same height as the miter saw table 31 so the mitered work piece 80 lays flat on both tables. Attached to the flip stop 54 is a miter fixture 11 which supports the 45 degree tip 99 of the mitered work piece 80 in surface contact, as opposed to line contact. Positioning the 45 degree point 99 of the mitered work piece 80 away from the fence is ideal because the force of the blade cutting the miter on the opposite end applies a uniform pressure against the stop guaranteeing that all of the mitered work pieces 80 will be cut at a uniform length. FIG. 24B is a detail view of FIG. 24A showing that the miter fixture 11 is comb-shaped with multiple fingers each with a 90 degree pointed tip 95 and having a T-slot 68 running along the side opposite from the fingers, the T-slot housing a bolt (not shown) that attaches it to the flip stop 54 with thumb nut 20. FIG. 24C is a top detail view of FIG. 24B showing how the 45 degree point 99 of the mitered work piece 80 is supported by two of the fingers each with a 90 degree pointed tip 95.

The miter fixture 11 is secured to the flip stop by a bolt that is tightened in place with a plastic thumb nut knob 20. Because the bolt slides in the T-slot, the fingers with a 90 degree pointed tip 95 can be moved to accommodate boards of different widths. The 45 degree point 99 of the mitered work piece 80 is fragile and is easily damaged. By positioning the 45 degree point 99 between the fingers each with a 90 degree pointed tip 95 that supports the tip 99 in surface contact, the point 99 is protected from damage, and the edge of the mitered work piece 80 is secured against the fence 46.

The 45 degree point 99 of the mitered corner 115 lines up with the 1 inch mark 117 on the miter fixture 11. The 45 degree point 99 of the mitered corner 115 is located one inch from the edge of the stop so the stick-on tape 50 can be easily used to measure the length of the work piece 80.

FIG. 24D is a detail view showing the miter fixture 11 with the 45 degree point 99 of the mitered work piece 80 reversed so that it is secured against the working plane of the fence 46. Surfaces 113 on the inner end of the fixture 11 and on the inner finger, which is shorter than the other fingers, are at 45 degrees, so that together with the finger adjacent to the inner finger the fingers present three surfaces in a 45 degree plane to support the mitered point 99 in surface contact.

Figure 25A:
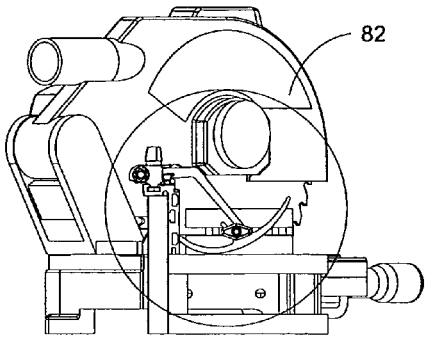
FIG. 25A is an end view of the flip stop and miter fixture as shown in FIG. 24A.
Figure 25B:
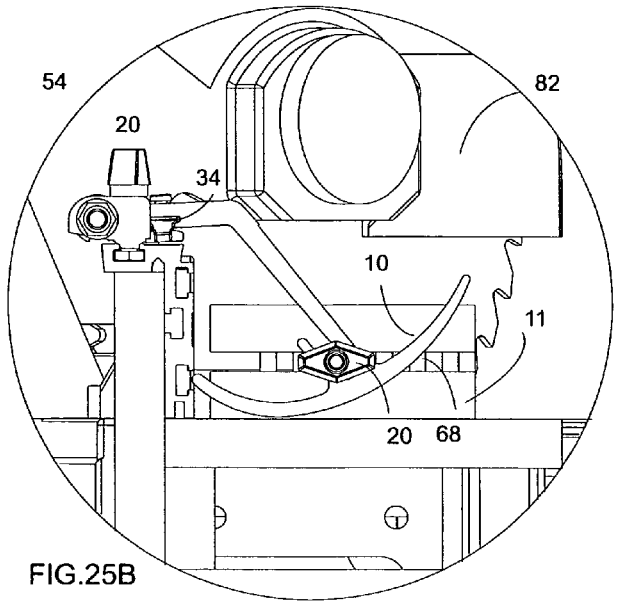
FIG. 25B is a detail view of the flip stop and miter fixture as shown in FIG. 25A.
Figure 26A:
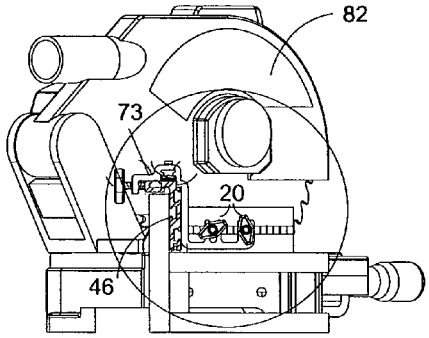
FIG. 26A is an end view of the fixed stop and miter fixture.
Figure 26B:
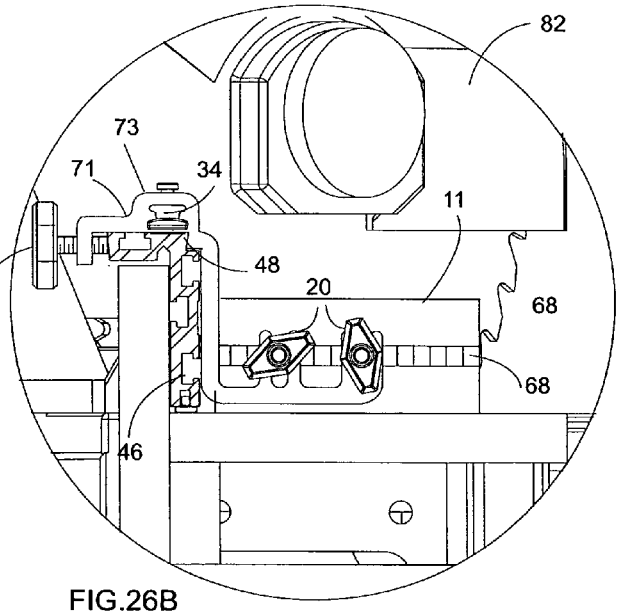
FIG. 26B is a detail view of the fixed stop and miter fixture as shown in FIG. 26A.
Figure 26C:
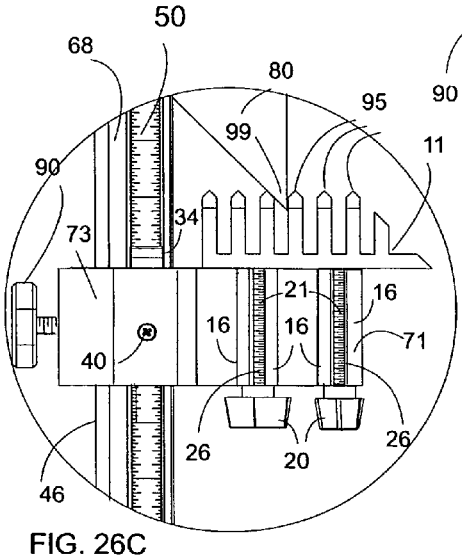
FIG. 26C is a top view of the fixed stop and miter fixture as shown in FIG. 26B with the point of the mitered board away from the fence.
Figure 27A:
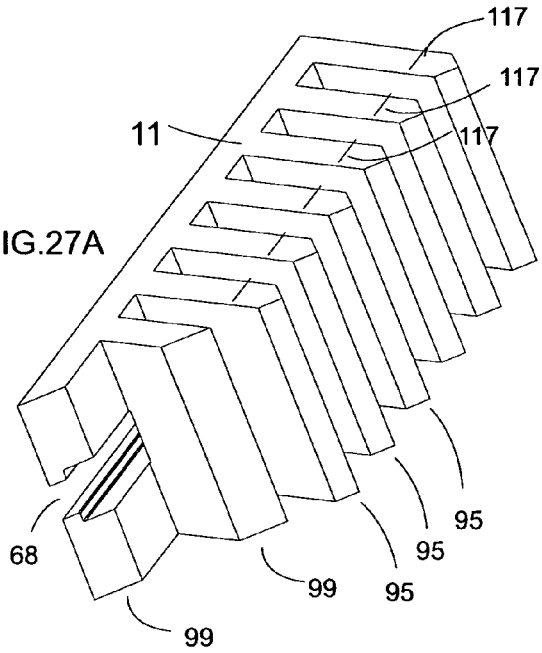
FIG. 27A is a perspective view of the miter fixture.
Figure 27B:
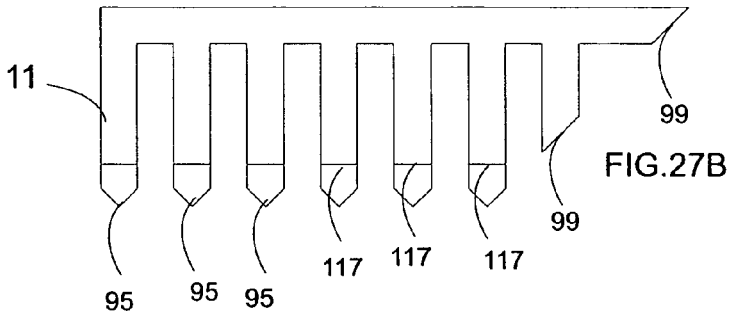
FIG. 27B is a top view of the miter fixture.
Figure 27C:
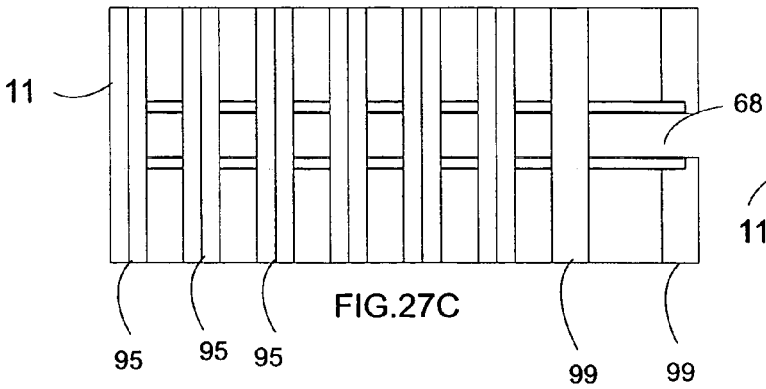
FIG. 27C is an end view of the miter fixture.
Figure 27D:
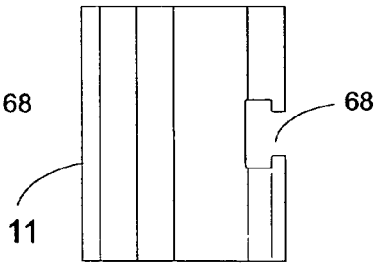
FIG. 27D is a front view of the miter fixture.

FIG. 25B is an end elevation of FIG. 24A. FIG. 26C is a top view of FIG. 26A and FIG. 26B showing the miter fixture 11 secured to the solid stop 71 with two bolts 26 located in the fixture mounting slots 21. FIG. 26C is a top view of FIG. 26A and FIG. 26B showing the miter fixture 11 secured to the solid stop 71 with two bolts 26 located in the fixture mounting slots 21. FIG. 27A is an perspective view of the miter fixture 11. FIG. 27B is a top view of the miter fixture 11 extruded aluminum shape. FIG. 27C is a front view of the miter fixture 11 showing the T-slot 68 machined in the side for the bolt head for securing it to the stop. FIG. 27D is an end view of the miter fixture 11.

I claim:

1. A woodworking machinery jig and fixture system comprising:

a woodworking support that defines a working plane; and a stop for guiding a workpiece supported by the woodworking support to position the workpiece relative to a woodworking tool, wherein a half-dovetail surface is formed on the stop, wherein the half-dovetail surface clamps against the woodworking support when the stop and the support are assembled together, and wherein the woodworking support has a mating half-dovetail surface against which the half dovetail surface of the stop clamps.

2. The woodworking machinery jig and fixture system of claim 1, wherein the stop includes a screw that can be tightened to bear against a side of the support opposite from the half-dovetail surface of the stop to clamp the half-dovetail surface of the stop against the support.

3. The woodworking machinery jig and fixture system of claim 1, wherein the half-dovetail surface of the stop clamps against a front side of the support.

4. The woodworking machinery jig and fixture system of claim 1, wherein a second half-dovetail surface is formed on the side of the support opposite from the side on which the half-dovetail surface of the stop clamps, said second half-dovetail surface bearing against an end of a fastener that clamps against the support.

5. The woodworking machinery jig and fixture system of claim 4, wherein both half-dovetail surfaces of the support are angled to face outwardly and downwardly.

6. The woodworking machinery jig and fixture system of claim 1, wherein the half-dovetail surface of the stop is at 9 degrees.

7. The woodworking machinery jig and fixture system of claim 1, wherein the support has a T-slot for mounting accessories.

8. A woodworking machinery jig and fixture system comprising:

a woodworking support that defines a working plane; and a stop for guiding a workpiece supported by the woodworking support to position the workpiece relative to a woodworking tool, wherein a half-dovetail surface is formed on the stop, wherein the half-dovetail surface clamps against the woodworking support when the stop and the support are assembled together, and wherein the support is L-shaped, having two legs that intersect at a top front corner, and wherein a mating half-dovetail surface is located on a front surface of the support at the top front corner, and wherein the half-dovetail surface of the stop clamps against the mating half-dovetail surface of the support.

9. The woodworking machinery jig and fixture system of claim 1, wherein the support includes a top track, the top track having a top leg and a back mounting flange extending downwardly at approximately a right angle from the top leg, so that the top leg is configured to be placed against a top surface of a board with the flange against a side surface of the board.

10. The woodworking machinery jig and fixture system of claim 9, wherein the top track has a mating half-dovetail surface against which the half-dovetail surface of the stop is clamped.

11. The woodworking machinery jig and fixture system of claim 9, further comprising fasteners placed through the flange to secure the top track to the board.

12. The woodworking machinery jig and fixture system of claim 11, wherein the flange has a line extruded into it that acts as a drill guide for drilling holes for the fasteners.

13. The woodworking machinery jig and fixture system of claim 1 further comprising a flip stop arm, wherein the stop includes a base on which the half-dovetail surface is formed, the base having multiple lateral through holes for mounting the flip stop arm using any of the through holes to facilitate various mounting heights of the flip stop arm in front of the support.

14. The woodworking machinery jig and fixture system of claim 13, wherein the through holes include a hole for mounting the flip stop arm, the system further comprising a zero clearance board as part of the support.

15. The woodworking machinery jig and fixture system of claim 1, wherein the woodworking support is a standard 2×4, wherein the stop is fitted to the standard 2×4.

16. A stop for a woodworking machinery jig and fixture system for mounting to a woodworking support that defines a working plane for guiding a workpiece supported by the woodworking support to position said workpiece relative to a woodworking tool, wherein the stop has a half-dovetail surface, wherein the stop is configured such that the half-dovetail surface clamps against the woodworking support when the stop and the support are assembled together.

17. The stop of claim 16, wherein the half-dovetail surface faces inwardly and is positioned toward the front of the stop.

18. The stop of claim 16, wherein the stop has fingers that extend laterally parallel to the working plane and define spaces between them, wherein the stop further comprises accessories mounted to the fingers with fasteners extending through the spaces.

19. The stop of claim 16, wherein the stop is configured to clamp to the support with the half-dovetail surface against a flat surface of the support.

* * * * *